US009745847B2

(12) United States Patent
Ditzler

(10) Patent No.: US 9,745,847 B2
(45) Date of Patent: Aug. 29, 2017

(54) CONDITIONAL OCCLUSION RELEASE DEVICE

(71) Applicant: Christopher A. Ditzler, Parker, CO (US)

(72) Inventor: Christopher A. Ditzler, Parker, CO (US)

(73) Assignee: BAKER HUGHES INCORPORATED, Houston, TX (US)

( * ) Notice: Subject to any disclaimer, the term of this patent is extended or adjusted under 35 U.S.C. 154(b) by 318 days.

(21) Appl. No.: 14/469,935

(22) Filed: Aug. 27, 2014

(65) Prior Publication Data

US 2016/0061018 A1 Mar. 3, 2016

(51) Int. Cl.

| | |
|---|---|
| ***E21B 47/06*** | (2012.01) |
| ***E21B 23/00*** | (2006.01) |
| ***E21B 43/26*** | (2006.01) |

(52) U.S. Cl.

CPC ..... *E21B 47/06* (2013.01); *E21B 23/00* (2013.01); *E21B 43/26* (2013.01)

(58) Field of Classification Search

CPC ..... E21B 43/116; E21B 23/04; E21B 43/26; E21B 47/06; E21B 23/00; E21B 33/12; E21B 33/13

See application file for complete search history.

(56) References Cited

U.S. PATENT DOCUMENTS

| | | | |
|---|---|---|---|
| 6,155,350 | A | 12/2000 | Melenyzer |
| 6,220,360 | B1 | 4/2001 | Connell et al. |
| 6,390,200 | B1 | 5/2002 | Allamon et al. |
| 6,802,372 | B2 | 10/2004 | Budde |
| 6,959,766 | B2 | 11/2005 | Connell |
| 7,703,523 | B2 | 4/2010 | Wardley |
| 7,770,652 | B2 | 8/2010 | Barnett |

(Continued)

FOREIGN PATENT DOCUMENTS

| | | | |
|---|---|---|---|
| WO | 2015038095 | A1 | 3/2015 |
| WO | 2015038096 | A1 | 3/2015 |

(Continued)

OTHER PUBLICATIONS

Notification Concerning Transmittal of International Preliminary Report on Patentability; International Application No. PCT/US2015/042244; International Filing Date: Jul. 27, 2015; Date of Mailing: Mar. 9, 2017; pp. 1-21.

*Primary Examiner* — Wei Wang
(74) *Attorney, Agent, or Firm* — Cantor Colburn LLP

(57) ABSTRACT

In one aspect, an apparatus for use in a wellbore is disclosed, including an occlusion retaining mechanism; an integrated controller configured to compare a plurality of downhole conditions to a plurality of predetermined release conditions and release an occlusion from the occlusion retaining mechanism in response to the plurality of downhole conditions satisfying the plurality of predetermined release conditions. In another aspect, a method for isolating a portion of a wellbore is disclosed, including deploying a frac plug in the wellbore; setting the frac plug in the wellbore; deploying a frac ball release tool in the wellbore; selectively retaining a frac ball within the frac ball release tool; releasing the frac ball in response to a plurality of downhole conditions satisfying a plurality of predetermined release conditions.

17 Claims, 2 Drawing Sheets

(56) References Cited

U.S. PATENT DOCUMENTS

| | | | | |
|---|---|---|---|---|
| 8,091,628 | B2 | 1/2012 | Peer et al. | |
| 2004/0055753 | A1 | 3/2004 | Davis et al. | |
| 2005/0039925 | A1 | 2/2005 | Connell | |
| 2007/0068679 | A1 | 3/2007 | Robichaux et al. | |
| 2008/0314638 | A1 | 12/2008 | Kaul et al. | |
| 2012/0037360 | A1* | 2/2012 | Arizmendi, Jr. | E21B 23/04 166/250.01 |
| 2012/0080202 | A1 | 4/2012 | Greenlee et al. | |
| 2014/0251612 | A1* | 9/2014 | Powers | E21B 33/1208 166/281 |
| 2015/0068771 | A1 | 3/2015 | Richards et al. | |
| 2015/0068772 | A1 | 3/2015 | Richards et al. | |
| 2015/0136425 | A1 | 5/2015 | Burgos et al. | |
| 2015/0252640 | A1 | 9/2015 | Mailand et al. | |
| 2015/0252642 | A1 | 9/2015 | Mailand et al. | |
| 2015/0252643 | A1 | 9/2015 | Mailand et al. | |
| 2016/0123129 | A1 | 5/2016 | Sanchez et al. | |
| 2016/0222764 | A1 | 8/2016 | Rorvik | |

FOREIGN PATENT DOCUMENTS

| | | | |
|---|---|---|---|
| WO | 2015084342 | A1 | 8/2015 |
| WO | 2015138254 | A1 | 9/2015 |
| WO | 2016069747 | A1 | 5/2016 |

* cited by examiner

CONDITIONAL OCCLUSION RELEASE DEVICE

BACKGROUND

1. Field of the Disclosure

This disclosure relates generally to occlusion release devices that facilitate the selective release of an occlusion in response to wellbore conditions.

2. Background

Wellbores are drilled in subsurface formations for the production of hydrocarbons (oil and gas). Hydrocarbons are trapped in various traps or zones in the subsurface formations at different depths. Such zones are referred to as reservoirs or hydro-carbon bearing formations or production zones. In production zones, it is often desired to perform completion operations such as plugging and perforation to facilitate production within the production zones. During such completion operations an occlusion or frac ball can be utilized to isolate flow within a particular zone. It is often desired to deliver the occlusion with the deployment of a perforation gun used for perforation operations to minimize operation time and expense. It is desired to selectively deliver the occlusion after certain wellbore conditions are met.

The disclosure herein provides an occlusion release devices that facilitate the selective release of an occlusion in response to wellbore conditions.

SUMMARY

In one aspect, an apparatus for use in a wellbore is disclosed, including an occlusion retaining mechanism; an integrated controller configured to compare a plurality of downhole conditions to a plurality of predetermined release conditions and release an occlusion from the occlusion retaining mechanism in response to the plurality of downhole conditions satisfying the plurality of predetermined release conditions.

In another aspect, a system for use in a wellbore is disclosed, including a frac plug deployed in the wellbore configured to receive a frac ball; a frac ball release tool, including a frac ball retaining mechanism associated with the frac ball; an integrated controller configured to compare a plurality of downhole conditions to a plurality of predetermined release conditions and deploy the frac ball in the wellbore from the frac ball retaining mechanism in response to the plurality of downhole conditions satisfying the plurality of predetermined release conditions.

In another aspect, a method for isolating a portion of a wellbore is disclosed, including deploying a frac plug in the wellbore; setting the frac plug in the wellbore; deploying a frac ball release tool in the wellbore; selectively retaining a frac ball within the frac ball release tool; releasing the frac ball in response to a plurality of downhole conditions satisfying a plurality of predetermined release conditions.

Examples of the more important features of certain embodiments and methods have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DETAILED DESCRIPTION OF THE DRAWINGS

Figure 1:
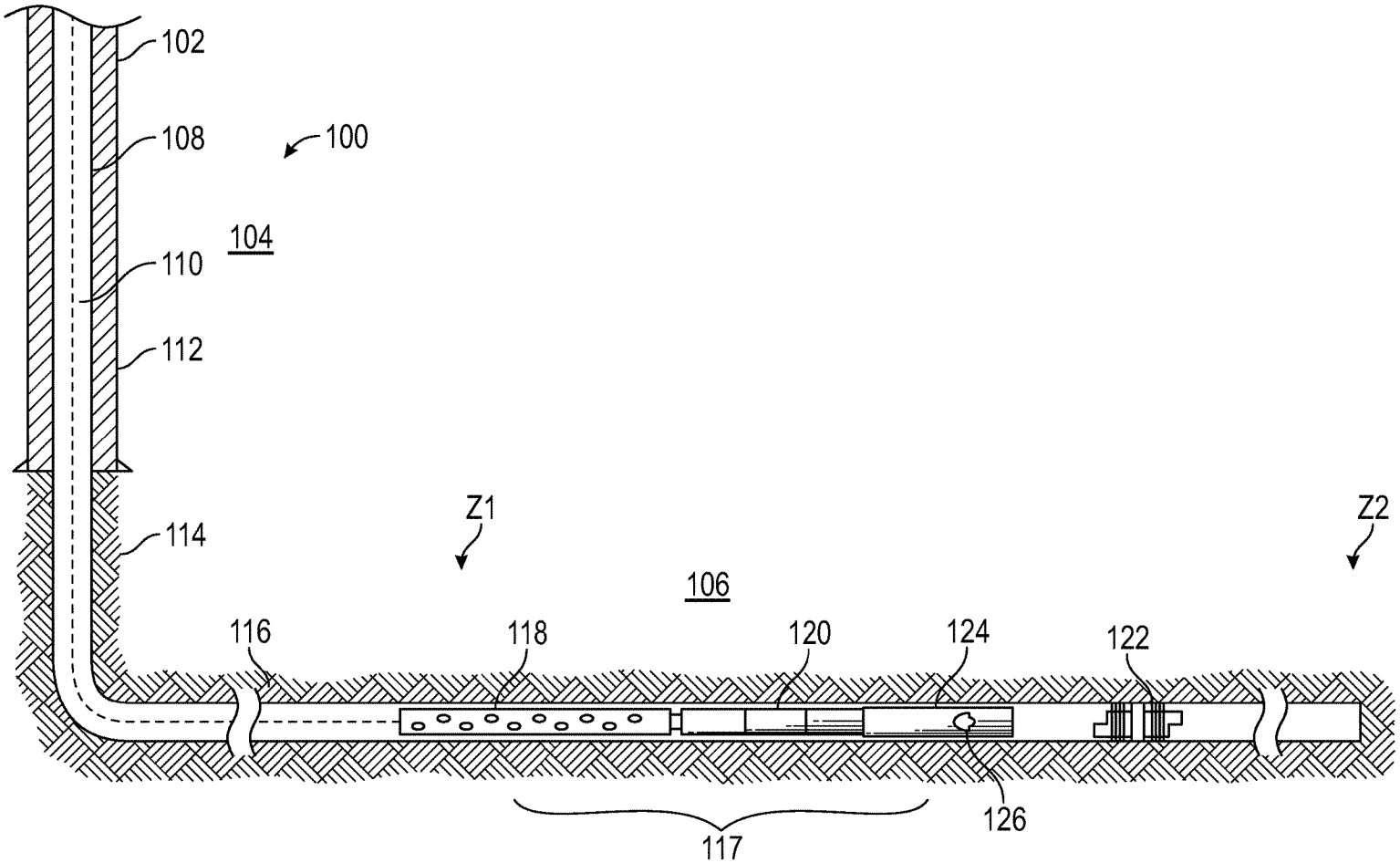
FIG. 1 shows an exemplary wellbore system that includes a occlusion release device, according to one non-limiting embodiment of the disclosure.

FIG. 1 is a line diagram of a wellbore system 100 that may be used for completion operations in a formation 104 with multiple production zones Z1, Z2, etc. In an exemplary embodiment, the system includes a casing 112 cemented in wellbore 102 formed in a formation 104. In certain embodiments, wellbore 102 is cemented with cement 116 in an open hole 114 without casing 112. Tubing or tubular 108 is deployed within wellbore 102 to a downhole location 106. In certain embodiments, downhole location 106 and zones Z1, Z2 are in horizontal or near horizontal orientations.

In an exemplary embodiment, during completion operations, such as "plug and perforation" operations, a perforation gun 118, frac plug setting tool 120 and a ball releasing tool 124 are deployed as bottom hole assembly (BHA) 117 to a downhole location 106 in a zone Z1, Z2, etc. In an exemplary embodiment, the BHA 117 is deployed via wireline 110. In alternative embodiments, the BHA 117 is deployed via coiled tubing. The frac plug setting tool 120 sets the frac plug 122 within tubing 108, wherein the frac plug 122 allows for a flow therethrough when unobstructed.

The perforation gun 118 may be fired in a downhole location 106. In response to wellbore events, wellbore conditions may change accordingly. After certain wellbore conditions are met, such as a combination of elapsed time, wellbore pressure, wellbore temperature, etc., the ball releasing tool 124 releases an occlusion, such as ball 126 into frac plug 122 to stop fluid flow beyond the plugged area to allow completion operations, such as fracing. In certain embodiments, it is desirable to deploy ball 126 into frac plug 122 after the perforation gun 118 has successfully created perforations at the downhole location 106. In an exemplary embodiment an operator may choose to release ball 126 when certain conditions are met or for any suitable operating parameter. In order to deploy the ball 126 under the desired conditions, ball releasing tool 124 is utilized to selectively release the ball 126. A non-limiting embodiment of a ball releasing tool 124 is described in reference to FIG. 2.

Figure 2:
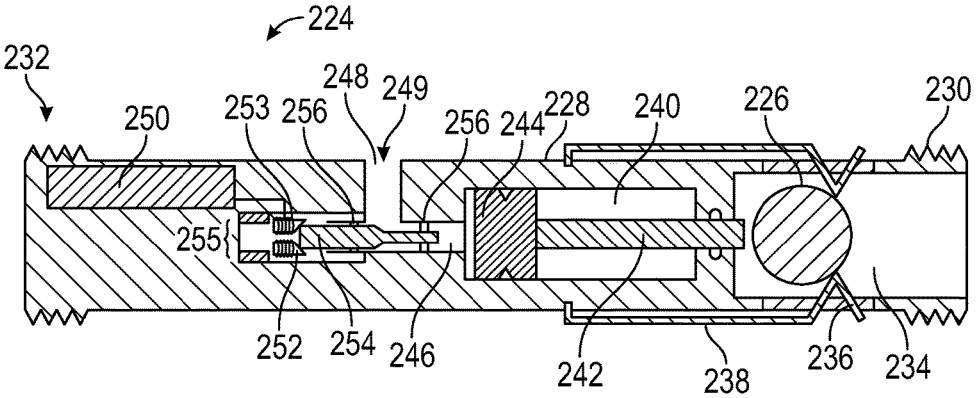
FIG. 2 shows a non-limiting embodiment of an occlusion release device for use in a wellbore system, including the wellbore system shown in FIG. 1, for deployment in a wellbore, such as wellbore shown in FIG. 1.

FIG. 2 shows a cross-sectional view of a non-limiting embodiment of a ball releasing tool for use in a wellbore system, including the wellbore system shown in FIG. 1 for deployment in a wellbore, such as wellbore shown in FIG. 1. The ball releasing tool 224 includes body 228, ball chamber 234, drive piston 244, and controller 250.

Body 228 includes an upper connection 232 and a lower connection 230. Upper connection 232 and lower connection 230 allow body 228 of ball releasing tool 214 to be assembled with other components in BHA 117 that may be deployed down hole together. In an exemplary embodiment, ball releasing tool 224 is coupled via upper connection 232 with BHA 117 to perforation gun 118 and frac plug setting tool 120. In other embodiments, ball releasing tool 224 is associated with other components to form BHA 117. Advantageously, this coupling allows for a single deployment for plugging operations, perforation operations, and ball release applications, minimizing time and expense.

Integrated controller 250 is disposed within ball release tool 224. In an exemplary embodiment, integrated controller 250 may operate independently and rely on battery power or any other suitable power source. In alternative embodiments, integrated controller 250 is cooperatively associated with other wellbore equipment. In an exemplary embodiment, integrated controller 250 is associated perforation gun 118 and is used to monitor the firing of the perforation gun 118. In other embodiments, integrated controller 250 monitors other relevant conditions.

In an exemplary embodiment, integrated controller 250 is preset with wellbore conditions, including, but not limited to desired elapsed time, pressure, and temperature. Such conditions may relate to, or signal a wellbore event or location of interest. Controller 250 then monitors those conditions at a downhole location 106 to see if such conditions are met via integrated or external sensors. In an exemplary embodiment, if all the desired conditions are met, such as time elapsed, pressure, and temperature, the controller allows shaft 254 to be displaced. An operator may configure the desired conditions.

Shaft 254 is retained in upper chamber 246 of tool 224. O-rings 256 provide a sealing relationship with shaft 254 while keeper 252 further retains the shaft 254 in an initial position. When integrated controller 250 provides the signal that the conditions are met, the shaft 254 is displaced. In an exemplary embodiment, keeper 252 is coil 255 wrapped with an electrical wire 253, which acts as a release mechanism or member. In certain embodiments, controller 250 provides an electrical signal to the electrical wire 253, wherein the resistance of the wire 253 causes the wire 253 to disintegrate or release. Accordingly, the coil 255 is displaced, causing shaft 254 to displace.

After shaft 254 is displaced, the sealing relationship between shaft 254 and upper chamber 246 is disrupted. Fluid flow 249 from port 248 is then received in upper chamber 246.

Drive piston 244 receives wellbore fluid in an upper chamber 246. The pressure differential between upper chamber 246 and lower chamber 240 causes fluid pressure on drive piston 244 to urge drive piston 244 toward a lower extent of ball release tool 224. As the drive piston 244 is urged downwardly, the drive shaft 242 pushes frac ball 226 against the force of the retainers 236 and retainer springs 238.

Until selectively released, frac ball 226 is selectively retained within an occlusion retaining mechanism, such as ball chamber 234. In an exemplary embodiment, frac ball 226 is retained by retainers 236 within ball chamber 234. Retainer springs 238 generally urge retainers 236 inward to keep frac ball 226 within ball chamber 234. The retainer springs 238 are selected to allow the force of the springs to be selectively overcome, without allowing frac ball 226 to be inadvertently deployed.

When the force of retainer springs 238 is overcome, the frac ball 226 is pushed out of the ball chamber 234 to be deployed in the wellbore 102. The frac ball 226 is then seated in a frac plug 122 when desired.

Advantageously, ball release tool 224 allows for frac ball 226 to be delivered during frac plug setting and perforation operations, saving operation time and expense. Further, ball release tool 224 allows for the redeployment of BHA 117 in the event of perforation gun 118 failures, particularly in horizontal wellbores. Additionally, the operation of ball release tool 224 is not necessarily linked to any particular wellbore event. Since controller 250 may monitor wellbore conditions, frac ball 226 may be released when conditions are met reflecting a wellbore event.

Therefore in one aspect, an apparatus for use in a wellbore is disclosed, including an occlusion retaining mechanism; an integrated controller configured to compare a plurality of downhole conditions to a plurality of predetermined release conditions and release an occlusion from the occlusion retaining mechanism in response to the plurality of downhole conditions satisfying the plurality of predetermined release conditions. In certain embodiments, the apparatus includes a displacement member associated with the occlusion retaining mechanism, wherein the integrated controller is configured to displace the displacement member in response to the plurality of downhole conditions satisfying the plurality of predetermined release conditions. In certain embodiments, the apparatus includes a release member associated with the displacement member, wherein the integrated controller is configured to activate the release member to release the displacement member in response to the plurality of downhole conditions satisfying the plurality of predetermined release conditions. In certain embodiments the plurality of downhole conditions includes at least a group consisting of time, temperature, and pressure. In certain embodiments, the apparatus includes a sealing member associated with the displacement member. In certain embodiments, the apparatus includes a flow port associated with the displacement member.

In another aspect, a system for use in a wellbore is disclosed, including a frac plug deployed in the wellbore configured to receive a frac ball; a frac ball release tool, including a frac ball retaining mechanism associated with the frac ball; an integrated controller configured to compare a plurality of downhole conditions to a plurality of predetermined release conditions and deploy the frac ball in the wellbore from the frac ball retaining mechanism in response to the plurality of downhole conditions satisfying the plurality of predetermined release conditions. In certain embodiments, the system includes a displacement member associated with the frac ball retaining mechanism, wherein the integrated controller is configured to displace the displacement member in response to the plurality of downhole conditions satisfying the plurality of predetermined release conditions. In certain embodiments, the system includes a release member associated with the displacement member, wherein the integrated controller is configured to activate the release member to release the displacement member in response to the plurality of downhole conditions satisfying the plurality of predetermined release conditions. In certain embodiments, the plurality of downhole conditions including at least a group consisting of time, temperature, and pressure. In certain embodiments, the system includes a sealing member associated with the displacement member. In certain embodiments, the system includes a flow port associated with the displacement member. In certain embodiments, the frac ball is configured to be set in the frac plug. In certain embodiments, the system includes a frac plug setting tool associated with the perforation gun. In certain embodiments, the system includes at least one of a wireline or a coiled tubing configured to convey the frac ball release tool.

In another aspect, a method for isolating a portion of a wellbore is disclosed, including deploying a frac plug in the wellbore; setting the frac plug in the wellbore; deploying a frac ball release tool in the wellbore; selectively retaining a frac ball within the frac ball release tool; releasing the frac ball in response to a plurality of downhole conditions satisfying a plurality of predetermined release conditions. In certain embodiments, the method includes displacing a displacement member associated with the frac ball release tool in response to the plurality of downhole conditions satisfying the plurality of predetermined release conditions; and providing a wellbore fluid flow to communicate with a drive member of the frac ball release tool. In certain embodiments, the method includes releasing the displacement member via a release member configured to activate in response to a plurality of downhole conditions satisfying the plurality of predetermined release conditions. In certain embodiments, the plurality of downhole conditions including at least a group consisting of time, temperature, and pressure. In certain embodiments, the method includes comprising comparing the plurality of downhole conditions to the plurality of predetermined release conditions.

The invention claimed is:

1. An apparatus for use in a wellbore, comprising:

an occlusion retaining mechanism to retain an occlusion within a chamber of the apparatus;

a displacement member associated with the occlusion retaining mechanism; and an integrated controller configured to compare a plurality of downhole conditions to a plurality of predetermined release conditions and release the occlusion from the occlusion retaining mechanism to deploy the occlusion from the apparatus into the wellbore in response to the plurality of downhole conditions satisfying the plurality of predetermined release conditions, wherein the integrated controller is configured to displace the displacement member to urge the occlusion to overcome a retaining force of the occlusion retaining mechanism and out of the chamber in response to the plurality of downhole conditions satisfying the plurality of predetermined release conditions.

2. The apparatus of claim 1, further comprising a release member associated with the displacement member, wherein the integrated controller is configured to activate the release member to release the displacement member in response to the plurality of downhole conditions satisfying the plurality of predetermined release conditions.

3. The apparatus of claim 1, the plurality of downhole conditions including at least a group consisting of time, temperature, and pressure.

4. The apparatus of claim 1, further comprising a sealing member associated with the displacement member.

5. The apparatus of claim 1, further comprising a port associated with the displacement member.

6. A system for use in a wellbore, comprising:

a frac plug deployed in the wellbore configured to receive a frac ball;

a frac ball release tool, comprising:

a frac ball retaining mechanism associated with the frac ball to retain the frac ball within a chamber of the frac ball release tool;

a displacement member associated with the frac ball retaining mechanism; and an integrated controller configured to compare a plurality of downhole conditions to a plurality of predetermined release conditions and deploy the frac ball from the frac ball retaining mechanism to deploy the frac ball from the frac ball release tool into the wellbore in response to the plurality of downhole conditions satisfying the plurality of predetermined release conditions, wherein the integrated controller is configured to displace the displacement member to urge the frac ball to overcome a retaining force of the frac ball retaining mechanism and out of the chamber in response to the plurality of downhole conditions satisfying the plurality of predetermined release conditions.

7. The system of claim 6, further comprising a release member associated with the displacement member, wherein the integrated controller is configured to activate the release member to release the displacement member in response to the plurality of downhole conditions satisfying the plurality of predetermined release conditions.

8. The system of claim 6, the plurality of downhole conditions including at least a group consisting of time, temperature, and pressure.

9. The system of claim 6, further comprising a sealing member associated with the displacement member.

10. The system of claim 6, further comprising a port associated with the displacement member.

11. The system of claim 6, wherein the frac ball is configured to be set in the frac plug.

12. The system of claim 6, further comprising a frac plug setting tool and a perforation gun associated with the frac ball release tool.

13. The system of claim 6, further comprising at least one of a wireline or a coiled tubing configured to convey the frac ball release tool.

14. A method for isolating a portion of a wellbore, comprising:

deploying a frac plug in the wellbore;

setting the frac plug in the wellbore;

deploying a frac ball release tool in the wellbore;

selectively retaining a frac ball within the frac ball release tool to retain the frac ball within a chamber of the frac ball release tool;

displacing a displacement member associated with the frac ball release tool to urge the frac ball to overcome a retaining force of the frac ball release tool-in response to the plurality of downhole conditions satisfying the plurality of predetermined release conditions; and providing a wellbore fluid flow to communicate with a drive member of the frac ball release tool;

deploying the frac ball from the chamber of the frac ball release tool into the wellbore in response to a plurality of downhole conditions satisfying a plurality of predetermined release conditions.

15. The method of claim 14, further comprising releasing the displacement member via a release member configured to activate in response to the plurality of downhole conditions satisfying the plurality of predetermined release conditions.

16. The method of claim 14, the plurality of downhole conditions including at least a group consisting of time, temperature, and pressure.

17. The method of claim 14, further comprising comparing the plurality of downhole conditions to the plurality of predetermined release conditions.

* * * * *